US008851407B2

(12) United States Patent
Okuya

(10) Patent No.: US 8,851,407 B2
(45) Date of Patent: Oct. 7, 2014

(54) APPARATUS FOR SHEARING AND BREAKING NONFERROUS CASTING

(75) Inventor: Yasuaki Okuya, Aichi (JP)

(73) Assignee: Yuatsuki Co., Ltd., Aichi (JP)

( * ) Notice: Subject to any disclaimer, the term of this patent is extended or adjusted under 35 U.S.C. 154(b) by 33 days.

(21) Appl. No.: 13/814,577

(22) PCT Filed: Aug. 18, 2011

(86) PCT No.: PCT/JP2011/069109

§ 371 (c)(1),
(2), (4) Date: Feb. 6, 2013

(87) PCT Pub. No.: WO2012/023632

PCT Pub. Date: Feb. 23, 2012

(65) Prior Publication Data

US 2013/0134249 A1 May 30, 2013

(30) Foreign Application Priority Data

Aug. 19, 2010 (JP) ..... 2010-184373

(51) Int. Cl.

| | |
|---|---|
| ***B02C 19/00*** | (2006.01) |
| ***B02C 17/04*** | (2006.01) |
| ***B02C 1/04*** | (2006.01) |
| ***B02C 1/10*** | (2006.01) |

(52) U.S. Cl.

CPC . *B02C 1/10* (2013.01); *B02C 1/043* (2013.01); *B02C 1/04* (2013.01)

USPC ..... 241/101.73; 241/264

(58) Field of Classification Search

USPC ..... 241/101.73, 264–266

See application file for complete search history.

(56) References Cited

U.S. PATENT DOCUMENTS

| | | | | |
|---|---|---|---|---|
| 5,791,573 | A * | 8/1998 | Okuya | 241/264 |
| 6,764,036 | B2 * | 7/2004 | Okuya | 241/264 |
| 7,086,620 | B2 * | 8/2006 | Okuya | 241/264 |
| 8,262,007 | B2 * | 9/2012 | Okuya | 241/264 |
| 2004/0217222 | A1 * | 11/2004 | Okuya | 241/264 |
| 2005/0061900 | A1 * | 3/2005 | Okuya | 241/264 |

FOREIGN PATENT DOCUMENTS

| | | |
|---|---|---|
| JP | 57-047068 | 10/1982 |
| JP | 63-000346 | 1/1988 |
| JP | 06-10683 | 4/1994 |
| JP | 2005-087915 | 4/2005 |
| JP | 48-52557 | 10/2011 |
| WO | 2008-050465 | 5/2008 |
| WO | 2008-062545 | 5/2008 |

* cited by examiner

*Primary Examiner* — Faye Francis

(74) *Attorney, Agent, or Firm* — Clark & Brody

(57) ABSTRACT

An apparatus for shearing and breaking nonferrous castings of the present invention includes a first cutter unit and a second cutter unit disposed in a frame. Each of the first cutter unit and the second cutter unit includes at least an intermediate cutter unit located at the intermediate stage and a lower cutter unit located at the lower stage. Each of the intermediate cutter units is a multi-vertex cutter part formed into a multi-vertex shape by rhombic cutting edges and crucial cutting edges connected to the respective intersections of diagonals of the rhombic cutting edges. The lower cutter units respectively have a concave cutting edge and a convex cutting edge which are engaged with a gap being formed therebetween.

10 Claims, 18 Drawing Sheets

(a)

(b)

(a)

(b)

APPARATUS FOR SHEARING AND BREAKING NONFERROUS CASTING

TECHNICAL FIELD

The present invention relates to an apparatus for shearing and breaking, mainly, nonferrous castings such as aluminum castings, which has a space for crushing defined between one cutter unit and the other cutter unit and pinches and presses to crush materials placed in the space by the one cutter unit and the other cutter unit.

BACKGROUND ART

As an apparatus for shearing aluminum, there is disclosed Japanese Patent Application Laid-Open No. 2005-87915 "Aluminum shearing apparatus", as Patent Document 1. Patent Document 1 discloses a shearing apparatus especially for shearing aluminum, using half-cut pyramid-shaped cutting edges each having a special cutting tooth shape. According to the description, the aluminum shearing apparatus includes one cutter unit and the other cutter unit facing each other, which are pivotally attached to a frame and have half-cut pyramid-shaped cutting edges disposed in a zigzag manner, movable means for shearing which moves the other cutter unit, an input opening for aluminum formed at free ends of the one cutter unit and the other cutter unit and a discharge opening formed via a supporting shaft disposed at base end portions of the one cutter unit and the other cutter unit, and pyramid-shaped inclined faces of the half-cut pyramid-shaped cutting edges ensure shearing of aluminum.

However, Patent Document 1 has a problem to be improved. Specifically, the lower portions of the one cutter unit and the other cutter unit are not bent and inclined. Therefore, if materials to be sheared, which are aluminum, have such shapes that cannot be sheared with the half-cut pyramid-shaped cutting edges, such as elongate materials, they may get through from the lower portions of the one cutter unit and the other cutter unit.

To solve the above problem, there is disclosed Japanese Patent Application Laid-Open No. 6-106083 "An apparatus for crushing and breaking weirs, runners, defective products or the like for casting by hydraulic pressure" in which strip-shaped cutting edges are formed on a lower end of a swinging cutter apparatus. According to the description, the apparatus for crushing and breaking weirs, runners, defective products or the like for casting by hydraulic pressure includes a stationary cutter apparatus having a number of tapered cutting edges provided in a frame which is open at the top and bottom faces thereof, a swinging cutter apparatus facing the stationary cutter apparatus and being pivotally fitted at the lower part of the frame, which has a number of tapered cutting edges which are in engaging relationship with the tapered cutting edges, a pressing means for swinging the swinging cutter apparatus and a discharge opening for discharging crushed and broken casting pieces which is provided below the swinging cutter apparatus and the stationary cutter apparatus, and at the lower end of the swinging cutter apparatus, strip-shaped cutting edges having inclined faces are formed ensuring the catching of undesired products such as elongate materials and rod-like materials.

In addition, Japanese Utility Model Application Laid-Open No 48-54557 "Crusher" is disclosed, which relates to a crusher including a fixed cutter and a movable cutter which are bent and inclined with an appropriate downward gradient at the respective lower end portions thereof. According to the description, the crusher includes a fixed cutter apparatus and a movable cutter apparatus that operates to crush materials by rotation of the eccentric shaft at the top end thereof, both cutters being opposed to each other at a predetermined engaging angle. At the respective lower ends of the fixed and movable cutter apparatuses, claw portions which are bent and inclined with an appropriate downward gradient toward the front are formed extendedly and rows of sawtooth cutting edges are laterally formed on the opposed faces of the claw portions. In this crusher, rows of cutting edges are longitudinally formed on the whole areas of the opposed faces of the fixed cutter apparatus and the movable cutter apparatus at the upper part, and rows of cutting edges are laterally formed on the whole areas of the opposed faces of the respective claw portions of the fixed cutter apparatus and the movable cutter apparatus.

PRIOR-ART DOCUMENTS

Patent Document 1 Japanese Patent Application Laid-Open No. 2005-87915

Patent Document 2 Japanese Patent Application Laid-Open No. 6-10683

Patent Document 3 Japanese Utility Model Application Laid-Open No. 48-52557

DISCLOSURE OF THE INVENTION

Problems to be Solved by the Invention

According to Patent Document 2, in order to ensure the catching of undesired products such as elongate materials and rod-like materials, strip-shaped cutting edges each having an inclined face are formed at the lower end of the swinging cutter apparatus. A number of cutting edges provided on the stationary cutter apparatus and the swinging cutter apparatus, however, are simple tapered cutting edges. In some cases, the simple shape of the cutting edges makes it difficult to finely crush and break weirs, runners, defective products or the like for casting. In addition, the invention of Patent Document is not specialized for shearing of aluminum.

Patent Document 3 has a simple constitution where the rows of sawtooth cutting edges are arranged in the longitudinal and lateral directions, and it does not have a construction of the present invention in which each of one cutter unit and the other cutter unit has an intermediate stage which is a multi-vertex cutter part and a lower stage which includes concave cutting edges and convex cutting edges. Therefore, in some cases, Patent Document 3 makes it difficult to finely crush materials to be crushed.

Means for Solving the Problems

An apparatus for shearing and breaking nonferrous castings which are materials to be crushed, comprises one cutting tool provided in a frame which is composed of two side plates and a bridging plate, the other cutting tool being opposed to the one cutting tool and being pivotally attached via a supporting shaft disposed to the frame; movable means for shearing and breaking which moves the other cutting tool; an input opening for nonferrous castings which are materials to be crushed, the input opening being formed between the upper parts of the one cutting tool and the other cutting tool; and a discharge opening having a converging shape and being formed between the lower parts of the one cutting tool and the other cutting tool, wherein the one cutting tool includes one base plate and one cutter unit disposed on the one base plate, and the other cutting tool includes the other base plate and the other cutter unit disposed on the other base plate, each of the one cutter unit and the other cutter unit is a cutter unit comprised of at least an intermediate cutter unit located on an intermediate stage and a lower cutter unit located on a lower stage, the intermediate cutter units of the one cutter unit and the other cutter unit have a substantially same shape, both of the cutter units being engaged with a gap formed therebetween to provide a shearing cutter unit, and each of the cutter units being a multi-vertex cutter part formed into a multi-vertex shape by a plurality of rhombic cutting edges combined and crucial cutting edges connected to respective intersections of diagonals of the rhombic cutting edges, the lower cutter units of the one cutter unit and the other cutter unit include a concave cutting edge and a convex cutting edge, respectively, and the concave cutting edge and the convex cutting edge are engaged with a gap formed therebetween.

According to the invention, materials to be crushed are finely sheared and broken by at least the intermediate cutter unit and the lower cutter unit. As a result, the conveying performance of sheared and broken materials is improved. In addition, size reduction of crushed materials improves the imputability of crushed materials into a melting furnace and their meltability and reduces the drop in temperature of molten metal. Further, size reduction of crushed materials makes a moisture pooling portion smaller, leading to less phreatic explosion.

In the apparatus for shearing and breaking nonferrous castings, each of the one cutter unit and the other cutter unit includes an upper cutter unit located at an upper stage thereof; and cutting teeth of the one cutter unit and the other cutter unit, when viewed from the side, are the shortest at the upper cutter unit of the upper stage and increase in height in the order from the intermediate cutter unit of the intermediate stage to the lower cutter unit of the lower stage, and the gap between the one cutting tool and the other cutting tool is the largest at the upper cutter unit and decreases in size in the order from the intermediate cutter unit to the lower cutter unit.

According to the invention, materials to be crushed are roughly sheared and broken on the intermediate stage, and as the materials move toward the lower stage, they are sheared and broken more finely gradually. Consequently, shearing and breaking is performed efficiently.

In the apparatus for shearing and breaking nonferrous castings, the crucial cutting edge has a first stage at a root side thereof and a second stage at a tip side thereof, the second stage having an angle larger than the first stage; and the tip of the second stage is chamfered.

According to the invention, the crucial cutting edge is divided into two stages, a first stage and a second stage, which have different angles, and the tip of the second stage is chamfered. Consequently, the strength of the crucial cutting edge can be maintained.

In the apparatus for shearing and breaking nonferrous castings, edge faces at the middle parts in the intermediate cutter units of the one cutter unit and the other cutter unit have concave and/or convex streaks.

According to the invention, adhesion of materials to be crushed to the intermediate cutter unit is reduced and any adhered material comes off easily. As a result, occurrence of built-up edges in the intermediate cutter unit can be prevented.

In the apparatus for shearing and breaking nonferrous castings, R, or radius, which is sufficiently large for the sizes of the materials to be crushed, is provided at a recess formed by the rhombic cutting edges and the crucial cutting edges which are the intermediate cutter units of the one cutter unit and the other cutter unit, the base face of the one base plate and the base face of the other base plate.

According to the invention, adhesion of materials to be crushed to the intermediate cutter unit or the base face is reduced and any adhered material comes off easily. As a result, occurrence of built-up edges in the intermediate cutter unit or the base face can be prevented.

In the apparatus for shearing and breaking nonferrous castings, the convex cutting edge of the lower cutter unit is formed substantially perpendicular to the other base plate; and the convex cutting edge includes a notch face which is a partially cut-out portion thereof.

According to the invention, the notch face of the convex cutting edge makes it easy to catch materials to be crushed on the convex cutting edge. As a result, shearing and breaking of the materials to be crushed is performed efficiently.

In the apparatus for shearing and breaking nonferrous castings, a claw portion is provided on a tip side of the convex cutting edge of the lower cutter unit.

According to the invention, the claw portion provided on the convex cutting edge makes it easy to catch materials to be crushed on the convex cutting edge. Therefore, shearing and breaking of the materials to be crushed is performed more efficiently.

In the apparatus for shearing and breaking nonferrous castings, one or more protrusions are provided on the surface of the concave cutting edge in the lower cutter unit of the one cutter unit.

According to the invention, one or more protrusions are provided on the surface of the concave cutting edge, preventing elongate materials from getting through from the lower part of the one cutting tool and the other cutting tool. As a result, materials to be crushed can be sheared and broken more finely.

In the apparatus for shearing and breaking nonferrous castings, the concave cutting edge in the lower cutter unit of the one cutter unit is cladded so that the engaging space between the concave and convex cutting edges is reduced when the other cutting tool moves forward.

According to the invention, the cladding formation reduces the engaging space between the concave and convex cutting edges when the other cutting tool moves forward and allows more efficient shearing and breaking. Further, it allows the sheared and broken materials to be pushed out to discharge.

In the apparatus for shearing and breaking nonferrous castings, one or more claw pieces are provided in the vicinity of the convex cutting edges of the lower cutter unit of the other cutter unit.

According to the invention, in the case where materials to be crushed adhere in the vicinity of the concave cutting edges of the one cutter unit, the adhered materials can be removed by the claw pieces when the other cutter unit having the claw pieces moves forward.

Effects of the Invention

According to the invention, materials to be crushed are finely sheared and broken by at least the intermediate cutter unit and the lower cutter unit. As a result, the conveying performance of sheared and broken materials is improved. Also, size reduction of crushed materials to be crushed improves the inputability of crushed materials into a melting furnace and their meltability and reduces a drop in temperature of molten metal. Further, size reduction of crushed materials makes a water pooling portion smaller, resulting in occurrence of less phreatic explosion.

Thus, an apparatus for shearing and breaking nonferrous castings which are materials to be crushed, comprises one cutting tool provided in a frame which is composed of two side plates and a bridging plate; the other cutting tool being opposed to the one cutting tool and being pivotally attached via a supporting shaft disposed to the frame; movable means for shearing and breaking which moves the other cutting tool; an input opening for nonferrous castings which are materials to be crushed, the input opening being formed between the upper parts of the one cutting tool and the other cutting tool; and a discharge opening having a converging shape and being formed between the lower parts of the one cutting tool and the other cutting tool, wherein the one cutting tool includes one base plate and one cutter unit disposed on the one base plate, and the other cutting tool includes the other base plate and the other cutter unit disposed on the other base plate, each of the one cutter unit and the other cutter unit is a cutter unit comprised of at least an intermediate cutter unit located on an intermediate stage and a lower cutter unit located on a lower stage, the intermediate cutter units of the one cutter unit and the other cutter unit have a substantially same shape, both of the cutter units being engaged with a gap formed therebetween to provide a shearing cutter unit, and each of the cutter units being a multi-vertex cutter part formed into a multi-vertex shape by a plurality of rhombic cutting edges combined and crucial cutting edges connected to respective intersections of diagonals of the rhombic cutting edges, the lower cutter units of the one cutter unit and the other cutter unit includes a concave cutting edge and a convex cutting edge, respectively, and the concave cutting edge and the convex cutting edge are engaged with a gap formed therebetween.

According to the invention, materials to be crushed are roughly sheared and broken at the intermediate stage, and as the materials move toward the lower stage, they are sheared and broken more finely gradually. As a result, shearing and breaking is performed efficiently and power required for crushing is reduced.

Thus, in the apparatus for shearing and breaking nonferrous castings, each of the one cutter unit and the other cutter unit includes an upper cutter unit located at an upper stage thereof; and cutting teeth of the one cutter unit and the other cutter unit, when viewed from the side, are the shortest at the upper cutter unit of the upper stage and increase in height in the order from the intermediate cutter unit of the intermediate stage to the lower cutter unit of the lower stage, and the gap between the one cutting tool and the other cutting tool is the largest at the upper cutter unit and decreases in size in the order from the intermediate cutter unit to the lower cutter unit.

According to the invention, the crucial cutting edge is divided into two stages, a first stage and a second stage, which have different slope angles, and the tip of the second stage is chamfered. Therefore, the strength of the crucial cutting edge can be maintained.

Thus, in the apparatus for shearing and breaking nonferrous castings, the crucial cutting edge has a first stage at a root side thereof and a second stage at a tip side thereof, the second stage having an angle larger than the first stage; and the tip of the second stage is chamfered.

According to the invention, adhesion of materials to be crushed to the intermediate cutter unit is reduced and any adhered materials come off easily. As a result, occurrence of built-up edges in the intermediate cutter unit can be prevented.

Thus, in the apparatus for shearing and breaking nonferrous castings, edge faces at the middle parts in the intermediate cutter units of the one cutter unit and the other cutter unit have concave streaks and/or convex streaks.

According to the invention, adhesion of materials to be crushed to the intermediate cutter unit or the base face is reduced and any adhered materials come off easily. As a result, occurrence of built-up edges in the intermediate cutter unit or the base face can be prevented.

Thus, in the apparatus for shearing and breaking nonferrous castings, wherein R, or radius, which is sufficiently large for the sizes of the materials to be crushed is provided at a recess formed by the rhombic cutting edges and the crucial cutting edges which are the intermediate cutter units of the one cutter unit and the other cutter unit, the base face of the one base plate and the base face of the other base plate.

According to the invention, a notch face provided on the convex cutting edge allows an efficient shearing and breaking of materials to be crushed.

Thus, in the apparatus for shearing and breaking nonferrous castings, the convex cutting edge of the lower cutter unit is formed substantially perpendicular to the other base plate; and the convex cutting edge includes a notch face which is a partially cut-out portion thereof.

According to the invention, a claw portion provided on the convex cutting edge allows materials to be crushed to be caught on the convex cutting edge, and shearing and breaking of materials to be crushed is performed more efficiently than in the invention of claim 6.

Thus, in the apparatus for shearing and breaking nonferrous castings, a claw portion is provided on a tip side of the convex cutting edge of the lower cutter unit.

According to the invention, one or more protrusions are provided on a surface of the projected part, preventing materials to be crushed from getting through from the lower part of the one cutting tool and the other cutting tool. As a result, an efficient shearing and breaking is performed.

Thus, in the apparatus for shearing and breaking nonferrous castings, one or more protrusions are provided on the surface of the concave cutting edge in the lower cutter unit of the one cutter unit.

According to the invention, the cladding formation reduces the engaging space between the concave and convex cutting edges when the other cutting tool moves forward and allows more efficient shearing and breaking. Further, it allows the crushed materials that were sheared and broken to be pushed out to discharge.

Thus, in the apparatus for shearing and breaking nonferrous castings, the concave cutting edge in the lower cutter unit of the one cutter unit is cladded so that the engaging space between the concave and convex cutting edges is reduced when the other cutting tool moves forward.

According to the invention, in the case where materials to be crushed adhere in the vicinity of the concave cutting edges of the one cutter unit, the adhered materials can be removed by the claw pieces when the other cutter unit having the claw pieces moves forward.

Thus, in the apparatus for shearing and breaking nonferrous castings, one or more claw pieces are provided in the vicinity of the convex cutting edges of the lower cutter unit of the other cutter unit.

BRIEF DESCRIPTION OF THE DRAWINGS

FIG. 14 are plan views illustrating a state in which Rs are provided at recesses formed by a rhombic cutting edge, crucial cutting edges and a base face of one base plate or the like: (a) is a plan view illustrating a state in which Rs are provided at recesses formed by a crucial cutting edge and a base face of one base plate or the like; and (b) is a plan view illustrating a state in which Rs are provided at recesses formed by rhombic cutting edges, a crucial cutting edge and a base face of one base plate or the like.

MODE FOR CARRYING OUT THE INVENTION

One embodiment of the present invention will be described.

Figure 1:
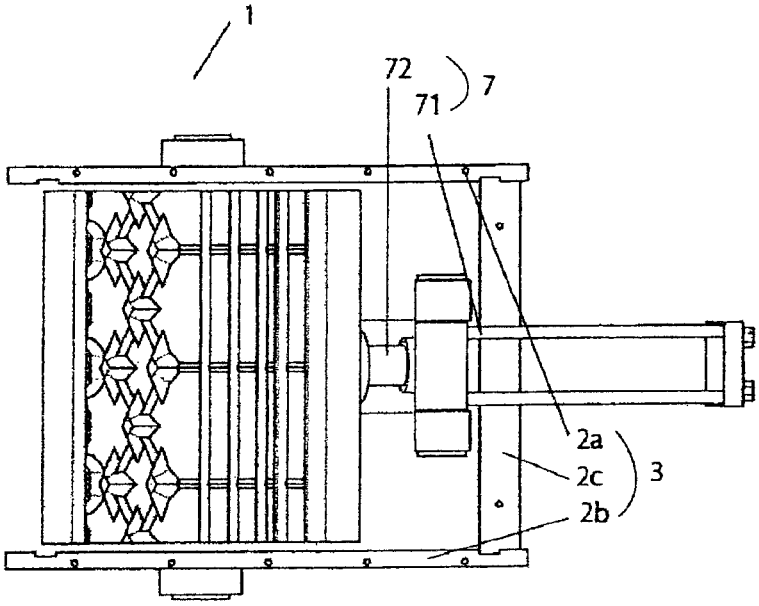
FIG. 1 is a plan view of one embodiment of a shearing and breaking apparatus showing the present invention.
Figure 2:
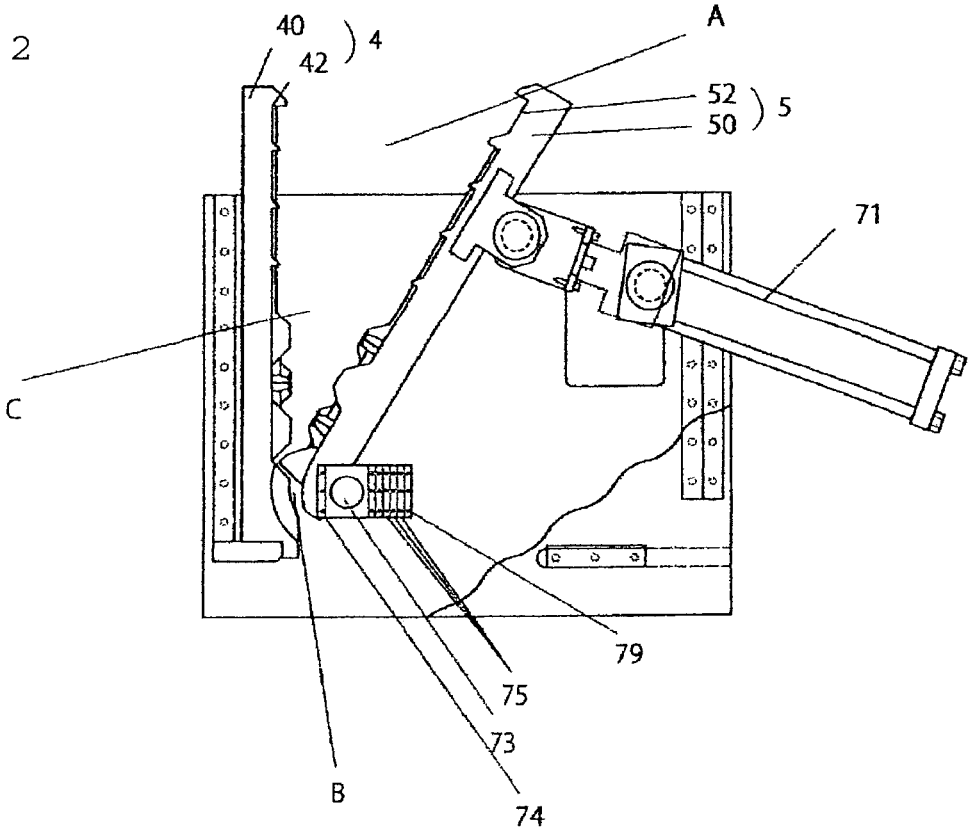
FIG. 2 is a side view of the embodiment of FIG. 1.
Figure 11:
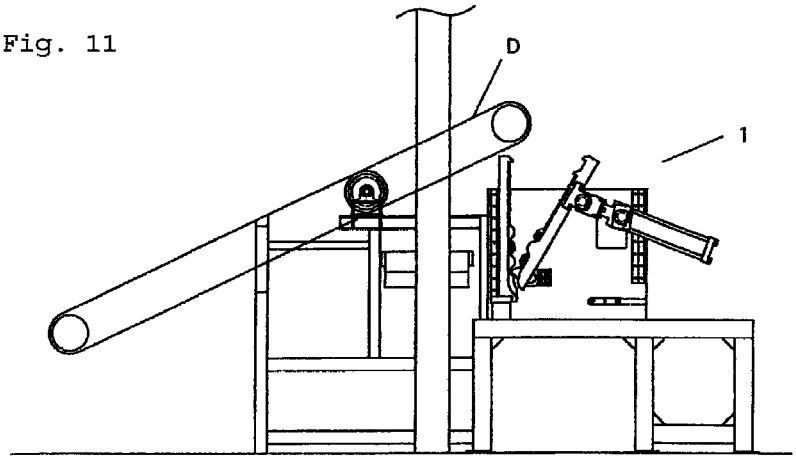
FIG. 11 is a scaled-down side view illustrating one example of usage state of the embodiment of FIG. 1.

Hereinafter, one embodiment of the shearing and breaking apparatus for nonferrous castings 1 of the present invention will be described with reference to the accompanying drawings. As shown in FIG. 1, the shearing and breaking apparatus for nonferrous castings 1 includes, as major components, a frame 3 which is composed of side plates 2*a*, 2*b* and a bridging plate 2*c* and is open at the top and bottom thereof, one cutting tool 4 disposed to the frame 3, the other cutting tool 5 opposed to the one cutting tool 4 and pivotally attached via a supporting shaft disposed to the frame and movable means 7 which moves the other cutting tool 5 forward and backward. An input opening A is formed between the upper parts of the one cutting tool 4 and the other cutting tool 5, and a discharge opening B having a converging shape is formed between the lower parts of the one cutting tool 4 and the other cutting tool 5. As shown in FIG. 11, materials to be crushed, which are nonferrous castings, are conveyed by a conveyor D, for example, and are put in through the input opening A and sheared and broken. That is, the present invention can finely break, cut, crush and destroy materials to be broken, and the finely broken materials are discharged through the discharge opening B.

The present invention is not limited to the embodiment described below, and various modifications can be made. Also, the present invention can shear and break, mainly, nonferrous castings, such as aluminum casting.

Figure 3:
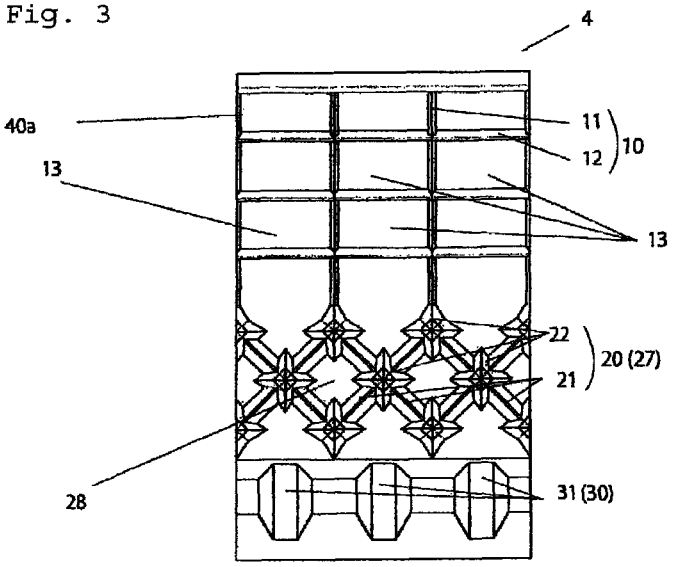
FIG. 3 is a front view of one cutting tool of the embodiment of FIG. 1.
Figure 4:
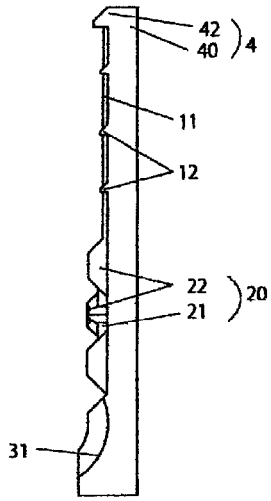
FIG. 4 is a side view of one cutting tool of the embodiment of FIG. 1.

FIGS. 3 and 4 show the one cutting tool 4 which is fixed.

Generally, the one cutting tool 4 is composed of a base plate 40 and one cutter unit 42 provided on the base plate 40.

Another example of the one cutting tool 4 is composed of a base plate 40, a tool post (not shown) detachably disposed to the base plate 40 and the one cutter unit 42 disposed to the tool post.

Figure 5:
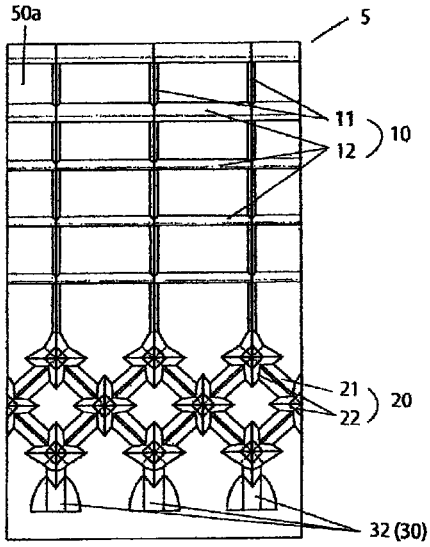
FIG. 5 is a front view of the other cutting tool of the embodiment of FIG. 1.
Figure 6:
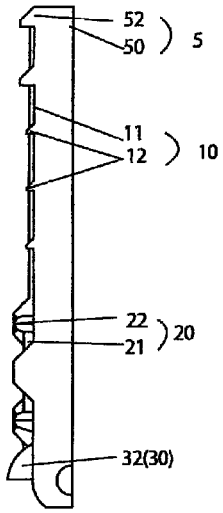
FIG. 6 is a side view of the other cutting tool of the embodiment of FIG. 1.
Figure 7:
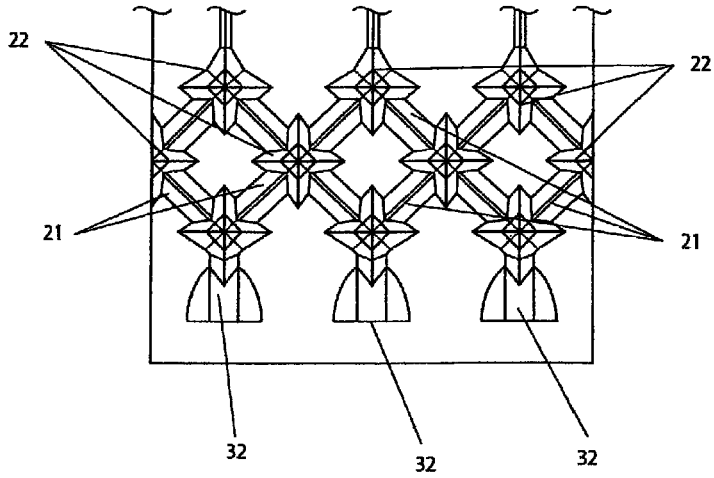
FIG. 7 is a front view of an intermediate cutter unit and a lower cutter unit of the other cutting tool of the embodiment of FIG. 1.
Figure 8:
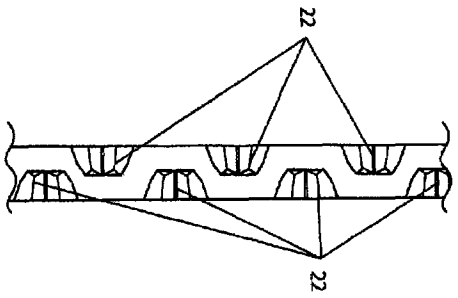
FIG. 8 is a plan view illustrating the fitting relationship of the crucial cutting edges of the intermediate cutter units of one cutting tool and the other cutting tool according to the embodiment of FIG. 1.
Figure 9:
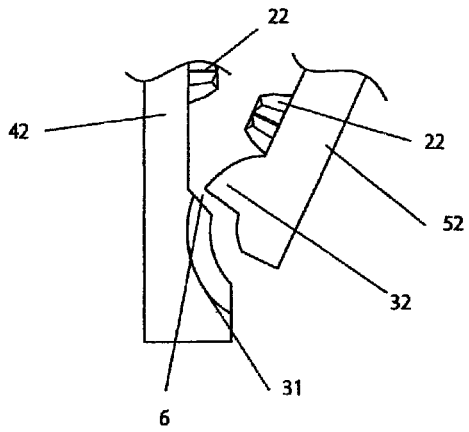
FIG. 9 is a side view illustrating the fitting relationship of the lower cutter units of one cutting tool and the other cutting tool according to the embodiment of FIG. 1.
Figure 10:
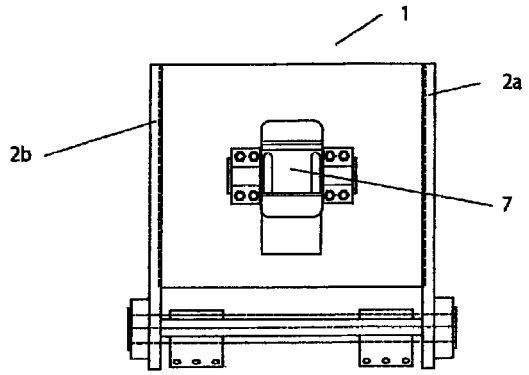
FIG. 10 is a rear view of the embodiment of FIG. 1.

FIGS. 5 and 6 show the other cutting tool 5 which is movable.

Generally, the other cutting tool 5 is composed of abase plate 50 and the other cutter unit 52 provided on the base plate 50.

Another example of the other cutting tool 5 is composed of a base plate 50, a tool post (not shown) detachably disposed to the base plate 50 and one cutter unit 52 disposed to the tool post.

As shown in FIGS. 4 and 6, each of the one cutter unit 42 and the other cutter unit 52 is configured by three stages: an upper cutter unit 10 located at the upper stage, an intermediate cutter unit 20 located at the intermediate stage and a lower cutter unit 30 located at the lower stage, but it is not limited to such a configuration and may be configured by two stages: the intermediate cutter unit 20 and the lower cutter unit 30. Also, the size, shape, width of the one cutter unit 42 and the other cutter unit 52 and intervals between them can be set as appropriate so that materials to be crushed can be sheared and broken efficiently.

The inclined cutting edge faces in the one cutter unit 42 and the other cutter unit 52 are characterized such that sheared and broken materials fall down surely and smoothly, durability and shearing/breaking performance of the cutter units are maintained, materials to be crushed or in-process materials to be crushed can be sheared completely, and materials to be crushed and or in-process materials to be crushed can be caught.

For cutting edges of the one cutter unit 42 and the other cutter unit 52, steel materials having a high hardness, such as hardened steel or manganese steel, are mainly used.

The upper cutter units 10 of the one cutter unit 42 and the other cutter unit 52 will be described.

The upper cutter unit 10 of the one cutter unit 42 and that of the other cutter unit 52 have a substantially same configuration, in which vertical cutting edges 11, which are vertically disposed on the one base plate 40 and the other base plate 50 with appropriate intervals, and horizontal cutting edges 12, which are laterally disposed with appropriate intervals, are assembled into a grid pattern to provide a screen having a number of mesh openings 13.

According to the configuration shown in FIGS. 4 and 6 which are the side views, the horizontal cutting edges 12 are higher than the vertical cutting edges 11. The configuration is not limited thereto, and the vertical cutting edges 11 may be higher than the horizontal cutting edges 12 or the vertical cutting edges 11 and the horizontal cutting edges 12 may be on the same level.

Also, the edge face of vertical cutting edge 11 and the horizontal cutting edge 12 may be inclined from the root side thereof toward the tip side thereof or may not be inclined.

The clearance C formed between the upper cutter unit 10 of the one cutter unit 42 and the upper cutter unit 10 of the other cutter unit 52 is used to shear and break materials to be crushed.

Next, the intermediate cutter units 20 of the one cutter unit 42 and the other cutter unit 52 will be described.

The intermediate cutter unit 20 of the one cutter unit 42 and the intermediate cutter unit 20 of the other cutter unit 52 have a substantially same configuration.

The configuration of these intermediate cutter units 20 will be described. First, rhombic cutting edges 21 and semi-rhombic cutting edges 21 are formed, and secondly, crucial cutting edges 22 are connected on the respective intersections of diagonals of the rhombic cutting edges 21. Therefore, the upper half portions of the crucial cutting edges 22 are located higher than the rhombic cutting edges 21.

Thus, the multi-vertex cutter part 27 is formed by combination of the apexes of the rhombic cutting edges 21 and the apexes (tips) of the crucial cutting edges 22.

Concerning the rhombic cutting edges 21, FIG. 3 shows an example of the configuration formed by combination of rhombic cutting edges 21 and semi-rhombic cutting edges 21, and FIG. 5 shows the configuration formed by only rhombic cutting edges 21.

The portion enclosed by four sides of a rhombic cutting edge 21 of the one cutter unit 42 or the other cutter unit 52 is a spot 28. When the other cutting tool 5 moves forward, the crucial cutting edges 22 of the other cutter unit 52 or the one cutter unit 42 will be placed in the vicinity of the spots 28.

The rhombic cutting edges 21 and the crucial cutting edges 22 in the intermediate cutter unit 20 have the faces that are inclined from the root side thereof toward the tip side thereof.

Figure 12:
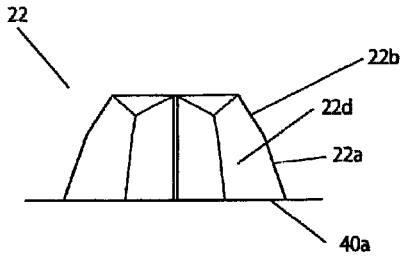
FIG. 12 is a plan view of a crucial cutting edge in the intermediate cutter unit of one cutting tool/other cutter unit of the embodiment of FIG. 1.

In another example, as shown in FIG. 12 and others, the root of the crucial cutting edge 22 is a first stage 22*a* and the tip is a second stage 22*b*. An angle 24*b* of the second stage 22*b* is larger than an angle 24*a* of the first stage 22*a*. In addition, the tip of the second stage 22*b* has been chamfered.

The angle 24*a* of the first stage 22*a* and the angle 24*b* of the second stage 22*b* in the intermediate cutter unit 20 may be selected in the range between 30 degrees and 90 degrees, but they may not be limited to an angle selected from the range as far as it can achieve the effects of the present invention.

Figure 13:
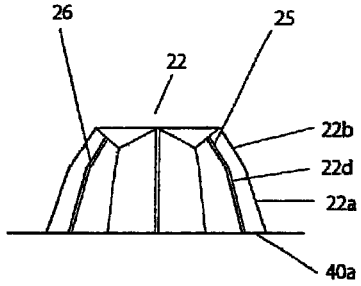
FIG. 13 are plan views illustrating a state in which a crucial cutting edge in the intermediate cutter unit of one cutting tool/other cutter unit of the embodiment of FIG. 1 has concave or convex streaks on the edge face at the middle part thereof: (a) is a plan view illustrating a state in which concave or convex streaks extend from the root side to the tip side on the cutting faces; and (b) is a plan view illustrating a state in which concave or convex streaks extend partially on the cutting faces.
Figure 13:
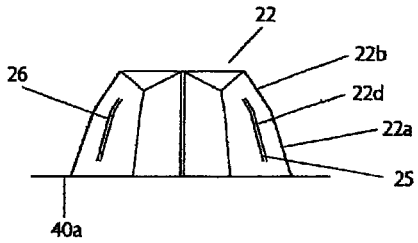

Further, the examples in which concave streaks 25 or convex streaks 26 are provided on the edge face at the middle part 22*d* of the intermediate cutter unit 20 are shown in FIG. 13(*a*) and FIG. 13(*b*). FIG. 13(*a*) shows a state in which a concave streak 25 and a convex streak 26 extend from the tip side to the root side of the edge face at the middle part 22*d* of the intermediate cutter unit 20. FIG. 13(*b*) shows a state in which a concave streak 25 and a convex streak 26 extend partly on the edge face at the middle part 22*d* of the intermediate cutter unit 20. Concave streaks 25 may be provided on both faces or convex streaks 26 may be provided on both faces. Also, as shown in FIG. 13(*a*) and FIG. 13(*b*), a concave streak 25 may be provided on one side and a convex streak 26 may be provided on the other side.

Figure 14:
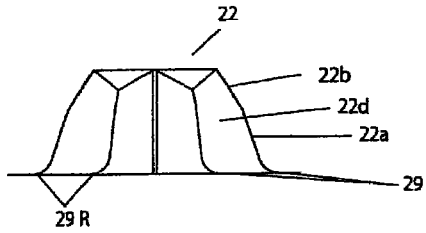
Figure 14:
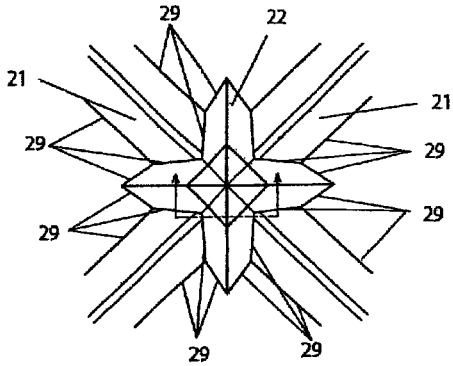
Figure 14:
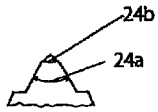

In FIG. 14(*a*) and FIG. 14(*b*) shown is a state in which Rs 29 which is sufficiently large for the sizes of materials to be crushed are provided at the recesses formed by the rhombic cutting edges 21 and the crucial cutting edge 22 in the intermediate cutter unit 20 of the one cutter unit 42 and the other cutter unit 52, the base face 40*a* of the one base plate 40 and the base face 50*a* of the other base plate 50. FIG. 14(*a*) shows a state in which Rs are provided at the recesses formed by the crucial cutting edge 22 and the base face 40*a* of the one base plate 40. FIG. 14(*b*) shows a state in which Rs are provided at the recesses formed by the rhombic cutting edges 21 and the crucial cutting edge 22, by the rhombic cutting edge 21 and the base face 40*a* of the one base plate 40 and by the crucial cutting edge 22 and the base face 40*a* of the one base plate 40. There is no special limitation to R 29, and any type of R 29 may be provided as far as it can achieve the effects of the present invention.

In the intermediate cutter units 20 of the one cutter unit 42 and the other cutter unit 52, materials to be crushed are sheared mainly by the clearance C formed therebetween.

The lower cutter units 30 of the one cutter unit 42 and the other cutter unit 52 will be described.

The lower cutter unit 30 of the one cutter unit 42 and the lower cutter unit 30 of the other cutter unit 52 are different from the upper cutter unit 10 or the intermediate cutter unit 20 and have a different configuration. That is, the lower cutter unit 30 of the one cutter unit 42 includes concave cutting edges 31, and the lower cutter unit 30 of the other cutter unit 52 includes convex cutting edges 32. The concave cutting edges 31 and the convex cutting edges 32 constitute a cutter unit which has a concave-convex engaging structure with a gap 6 formed between the cutting edges 31 and 32. The concave cutting edges 31 and the convex cutting edges 32 are engaged, thereby shearing and breaking materials.

The gap 6 serves as a path through which some of sheared and broken materials pass.

Figure 15:
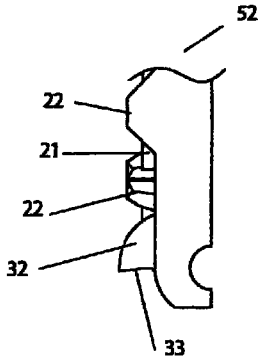
FIG. 15 is a side view illustrating a state in which a convex cutting edge in the lower cutter unit of the other cutter unit includes a notch face which is a partially cut-out portion thereof.

FIG. 15 shows a state in which the convex cutting edge 32 of the lower cutter unit 30 is formed substantially perpendicular to the other base plate 50 and has a notch face 33 which is a partially cut-out portion thereof. Making a notch face 33 larger ensures increase in rigidity.

Figure 16:
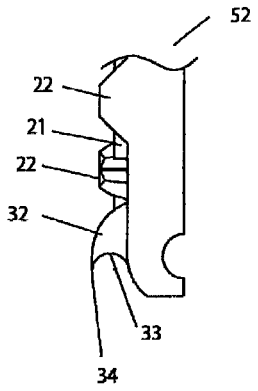
FIG. 16 is a side view illustrating a state in which a notch face is provided on a part of a convex cutting edge in the lower cutter unit of the other cutter unit and a claw portion is provided at the tip side of the convex cutting edge.

FIG. 16 shows a state in which a claw portion 34 is provided at the tip side of the convex cutting edge 32 of the lower cutter unit 30 having a notch face 33. In this way it is desirable that the claw portion 34 is provided at the tip side. The claw portion 34 may be provided on the convex cutting edge 32 without a notch face 33.

Figure 17:
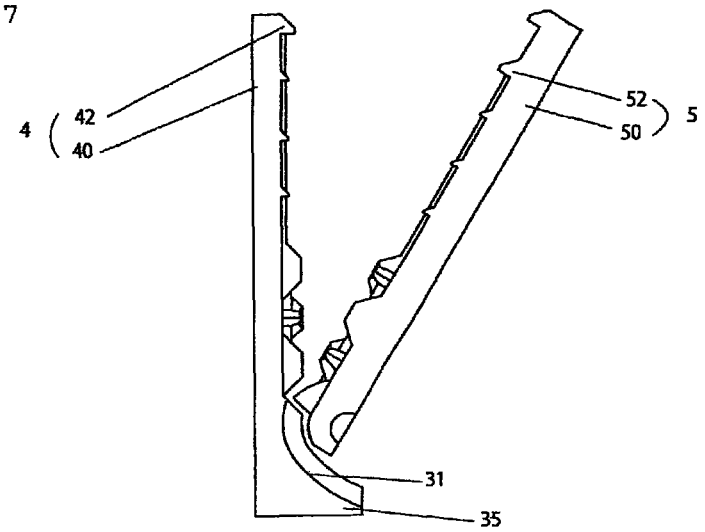
FIG. 17 is a side view illustrating a state in which a concave cutting edge of one cutting tool is extended more than that of the embodiment of FIG. 1

FIG. 17 shows a state in which the concave cutting edge 31 is extended more than that of the embodiment of FIG. 1.

Figure 19:
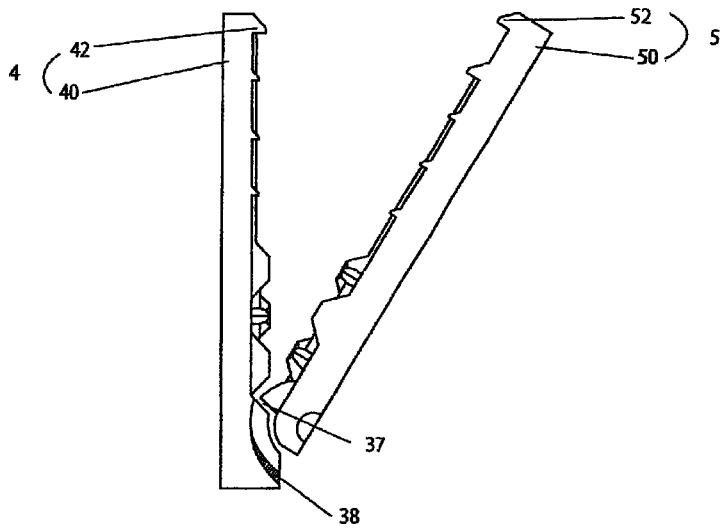
FIG. 19 is a side view illustrating a state in which cladding is formed on the concave cutting edge of one cutting tool.

By formation of cladding 38 on the concave cutting edge 31 as shown in FIG. 19, the concave-convex engaging space 37 is reduced gradually when the other cutting tool 5 moves forward, and materials to be crushed are sheared and broken more finely.

Figure 18:
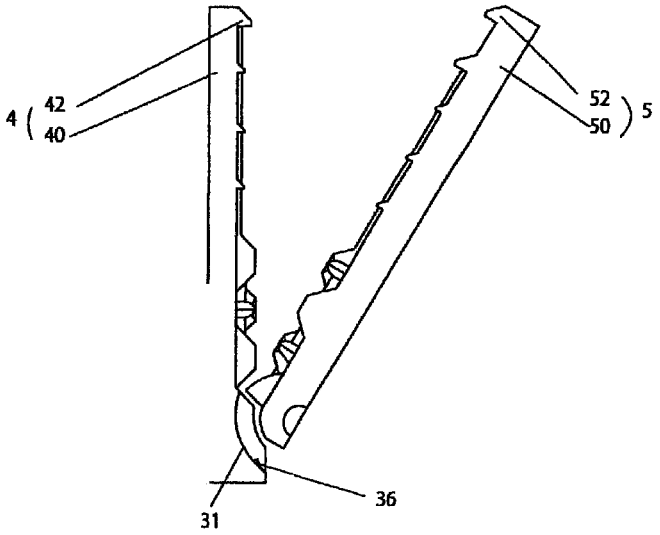
FIG. 18 is a side view illustrating a state in which one or more protrusions are provided on the surface of the concave cutting edge of one cutting tool.

FIG. 18 shows a state in which one or more protrusions 36 are provided on the surface of the concave cutting edge 31. The protrusion 36 may be provided in any position on the surface of the concave cutting edge 31 as far as it can prevent elongate materials from slipping off through it. In addition, there is no limitation about the shape of the protrusion 36 as far as it can achieve the effects of the present invention. The protrusion 36 may have a halved abacus-bead shape or acuminate or raised shape, for example.

As another example, half-cut convex cutting edges 32 may be provided at the edge of the other base plate 50. Specifically, the side face of the other base plate 50 may be flush with the side face of the half-cut convex cutting edge 32, and a part of the convex cutting edge 32 may be notched.

Notching a part of the convex cutting edge 32 will create a claw, which catches materials more easily, resulting in a more efficient shearing and breaking.

Figure 20:
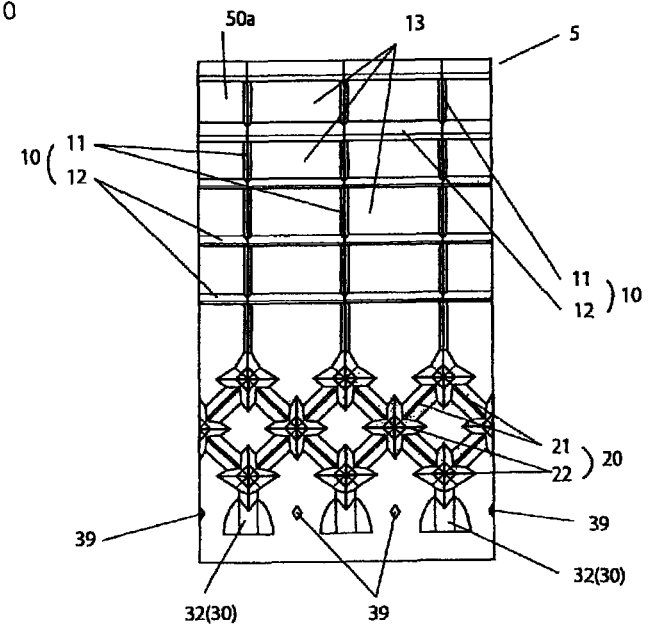
FIG. 20 is a front view of the other cutting tool which is provided with claw pieces in the vicinity of the convex cutting edges.

FIG. 20 shows a state in which one or more claw pieces 39 are provided in the vicinity of the convex cutting edges 32 of the lower cutter unit 30 of the other cutter unit 52. In the case where materials to be crushed adhere in the vicinity of the concave cutting edges 31 of the one cutter unit 42, the adhered materials to be crushed can be removed by the claw pieces 39 when the other cutter unit 52 having the claw pieces 39 moves forward.

The claw pieces 39 may be provided on any position in the vicinity of the convex cutting edges 32. For example, as shown in FIG. 20, the claw pieces 39 may be provided on both right and left positions of the convex cutting edges 32. The claw piece 39 may have a rhombic shape as shown in FIG. 20 or a half-cut rhombic shape. In addition, the claw piece 39 may have any size. In other words, the claw pieces 39 may be provided at any position, and in any shape, size or quantity, as far as they can achieve the effect described above.

In one configuration of the one cutter unit 42 and the other cutter unit 52, the cutting teeth of the upper cutter unit 10, the intermediate cutter unit 20 and the lower cutter unit 30 may be on the same level, when viewed from the side. In another configuration of the one cutter unit 42 and the other cutter unit 52, the cutting teeth are the shortest at the upper cutter unit 10 and increases in height in the order from the intermediate cutter unit 20 to the lower cutter unit 30, when viewed from the side. In this case, the gap between the one cutter unit 42 and the other cutter unit 52 is the largest at the upper cutter units 10 and decreases in size in the order from the intermediate cutter units 20 to the lower cutter units 30. According to these configurations, large materials to be crushed are sheared and broken by the upper cutter units 10 and small materials to be crushed are sheared and broken by the lower cutter units 30.

The tip of a piston rod 72 of a cylinder 71 is fixed to the base plate 50 on the rear side of the movable other cutting tool 5. The base plate 50 is configured so that the other cutting tool 5 is pushed out by the cylinder 71. For the cylinder 71, a fluidic cylinder in which hydraulic fluid or air pressure is used as a working fluid may be used. More specifically, a hydraulic cylinder apparatus includes a linear feed driving mechanism in which materials put into the portion between the one cutter unit 42 and the other cutter unit 52 are broken by back and forth motion of the piston rod 72. Therefore, the other cutting tool is gradually displaced by the linear feed drive unit of the hydraulic cylinder, and a strong hydraulic pressure is exerted on materials to be crushed to shear and break them.

A supporting shaft 73 of the other cutting tool 5 is supported with the use of a bearing 74 and a supporting block 75 fitted in a frame hole 79 which is largely opened in the frame 3. The supporting blocks 75 fitted in the frame hole 79 are inserted or removed to adjust the numbers of the supporting blocks 75 on the right and left sides, so that the position of the supporting shaft 73 can be changed. A metal 76, an eccentric bush 77 and a stopper 78 are provided to the bearing 74. When the stopper 78 is released, the eccentric bush 77 is rotated as appropriate to change the position of the supporting shaft 73. After the position is changed, the changed position is fixed by the stopper 78 to fasten the eccentric bush 77. Through this operation, the position of the supporting shaft 73 is changed and the supporting shaft 73 is fixed at the changed position. Also, the position of the supporting shaft 73 can be changed even if the numbers of the supporting blocks 75 on the right and left sides in the frame hole 79 are changed. The eccentric bush 77 can be taken out by half-cutting the bearing.

DESCRIPTION OF REFERENCE NUMERALS

1 apparatus for shearing and breaking
2*a* side plate
2*b* side plate
2*c* bridging plate
3 frame
4 one cutting tool
40 one base plate
40*a* base face
42 one cutter unit
5 other cutting tool
50 other base plate
50*a* base face
52 other cutter unit
6 gap
7 movable means
71 cylinder
72 piston rod
73 supporting shaft
74 bearing
75 supporting block
78 stopper
79 frame hole
10 upper cutter unit
11 vertical cutting edge
12 horizontal cutting edge
13 mesh opening
20 intermediate cutter unit
21 rhombic cutting edge
22 crucial cutting edge
22*a* first stage
22*b* second stage
22*d* edge face at the middle part
24*a* angle
24*b* angle
25 concave streak
26 convex streak
27 multi-vertex cutter part
28 spot
29 R
30 lower cutter unit
31 concave cutting edge
32 convex cutting edge
33 notch face
34 claw portion
35 extended portion
36 protrusion
37 engaging space
38 cladding
39 claw piece
A input opening
B discharge opening
C clearance
D conveyor

The invention claimed is:

1. An apparatus for shearing and breaking nonferrous castings which are materials to be crushed, comprising:

a first cutting tool provided in a frame which is composed of two side plates and a bridging plate;

a second cutting tool being opposed to the first cutting tool and being pivotally attached via a supporting shaft disposed to the frame;

movable means for shearing and breaking which moves the second cutting tool;

an input opening for nonferrous castings which are materials to be crushed, the input opening being formed between upper parts of the first cutting tool and the second cutting tool; and a discharge opening having a converging shape and being formed between lower parts of the first cutting tool and the second cutting tool, wherein the first cutting tool includes a first base plate and a first cutter unit disposed on the first base plate, and the second cutting tool includes a second base plate and a second cutter unit disposed on the second base plate, each of the first cutter unit and the second cutter unit is a cutter unit comprised of at least an intermediate cutter unit located on an intermediate stage and a lower cutter unit located on a lower stage, each of the intermediate cutter units of the first cutter unit and the second cutter unit are similar in shape, both of the first and second cutter units being engaged with a gap formed therebetween to provide a shearing cutter unit, and each of the first and second cutter units being a multi-vertex cutter part formed into a multi-vertex shape by a plurality of rhombic cutting edges combined and crucial cutting edges connected to respective intersections of diagonals of the rhombic cutting edges, the lower cutter units of the first cutter unit and the second cutter unit including a concave cutting edge and a convex cutting edge, respectively, and the concave cutting edge and the convex cutting edge are engaged with a gap formed therebetween.

2. The apparatus for shearing and breaking nonferrous castings according to claim 1, wherein each of the first cutter unit and the second cutter unit includes an upper cutter unit located at an upper stage thereof, and cutting teeth of the first cutter unit and the second cutter unit, when viewed from the side, are shortest at the upper cutter unit of the upper stage and increase in height in order from the intermediate cutter unit of the intermediate stage to the lower cutter unit of the lower stage, and the gap between the first cutting tool and the second cutting tool is largest at the upper cutter unit and decreases in size in order from the intermediate cutter unit to the lower cutter unit.

3. The apparatus for shearing and breaking nonferrous castings according to claim 1, wherein the crucial cutting edge has a first stage at a root side thereof and a second stage at a tip side thereof, the second stage having an angle larger than the first stage; and a tip of the second stage is chamfered.

4. The apparatus for shearing and breaking nonferrous castings according to claim 1, wherein edge faces at middle parts in the intermediate cutter units of the first cutter unit and the second cutter unit have concave and/or convex streaks.

5. The apparatus for shearing and breaking nonferrous castings according to claim 1, wherein R, a radius, which is sufficiently large for the sizes of materials to be crushed, is provided at a recess formed by the rhombic cutting edges and the crucial cutting edges which form the intermediate cutter units of the first cutter unit, the second cutter unit, a base face of the first base plate, and a base face of the second base plate.

6. The apparatus for shearing and breaking nonferrous castings according to claim 1, wherein the convex cutting edge of the lower cutter unit of the second cutter unit is formed substantially perpendicular to the second base plate; and the convex cutting edge includes a notch face which is a partially cut-out portion thereof.

7. The apparatus for shearing and breaking nonferrous castings according to claim 1, wherein a claw portion is provided on a tip side of the convex cutting edge of the lower cutter unit of the second cutter unit.

8. The apparatus for shearing and breaking nonferrous castings according to claim 1, wherein one or more protrusions are provided on a surface of the concave cutting edge in the lower cutter unit of the first cutter unit.

9. The apparatus for shearing and breaking nonferrous castings according to claim 1, wherein the concave cutting edge in the lower cutter unit of the first cutter unit is clad so that the gap between the concave and convex cutting edges is reduced when the second cutting tool moves forward.

10. The apparatus for shearing and breaking nonferrous castings according to claim 1, wherein one or more claw pieces are provided in a vicinity of the convex cutting edge of the lower cutter unit of the second cutter unit.

* * * * *